United States Patent [19]

Kouklik

[11] 4,019,349

[45] Apr. 26, 1977

[54] METHOD AND APPARATUS FOR ELECTRONIC CONTROL OF MULTIFEED CIRCULAR KNITTING MACHINES

[75] Inventor: Ivo Kouklik, Trebic, Czechoslovakia

[73] Assignee: Elitex, Zavody textilniho strojirenstvi generalni reditalstvi, Liberec, Czechoslovakia

[22] Filed: Nov. 1, 1974

[21] Appl. No.: 519,830

[30] Foreign Application Priority Data

Nov. 2, 1973 Czechoslovakia ..... 7532/73

[52] U.S. Cl. ..... 66/154 A

[51] Int. Cl.[2] ..... D04B 15/66

[58] Field of Search ..... 66/50 R, 154 A

[56] References Cited

UNITED STATES PATENTS

| | | | |
|---|---|---|---|
| 3,831,402 | 8/1974 | Schuman | 66/50 R |
| 3,844,139 | 10/1974 | DeGerjat et al. | 66/50 R |
| 3,896,297 | 7/1975 | Ploppa | 66/154 AX |
| 3,940,951 | 3/1976 | Christiansen | 66/50 R |

FOREIGN PATENTS OR APPLICATIONS

| | | | |
|---|---|---|---|
| 1,961,021 | 6/1971 | Germany | 66/50 R |
| 2,216,096 | 10/1972 | Germany | 66/50 R |
| 1,324,426 | 7/1973 | United Kingdom | 66/50 R |

*Primary Examiner*—Mervin Stein
*Assistant Examiner*—A. M. Falik

[57] ABSTRACT

An electronically controlled multifeed circular knitting machine having an electromagnet needle selector in each knitting feed system. A matrix is provided for storing the operating pattern of the needles with respect to the formation of loops in each wale and course, and a reading device for activating the matrix in dependence on the position of the needles. The reading device includes a counter for determining the passage of the needles determining and successively feeding to the input of the matrix data as to the specific needle located at each electromagnet. The output of the matrix is fed to a sweep circuit connected to the electromagnet associated with the respective feed system for each data input.

8 Claims, 4 Drawing Figures

METHOD AND APPARATUS FOR ELECTRONIC CONTROL OF MULTIFEED CIRCULAR KNITTING MACHINES

BACKGROUND OF THE INVENTION

The present invention relates to an electrically controlled multifeed circular knitting machine and in particular to a method and apparatus for determining the specific needle placed at any given feed system and for controlling the output of the pattern matrix in accordance therewith.

In multifeed knitting machines having electronic patterning devices, particularly in small diameter circular knitting machines, the needles are divided into separate knitting systems with independent yarn feeds each system having electrically operated means, such as an electromagnet, for selectively actuating the needles. The actual electromagnetic selectors for each of the separate knitting feeds are distributed about the circumference of the needle cylinder of the machine so as not to interfere with each other. A storage or recording matrix is provided which contains the patterning information for each knitting group or system of needles, with respect to its wale and course. A reading device is further provided to activate the output of the matrix with respect to the position of the needles in each of the knitting systems. The reading device is connected to a unidirectional counter which determines the passage of the needles during the knitting operation so that the output of the pattern storage or recording matrix and the needles can be synchronized. The output of the recording or storage matrix is connected to each of the electromagnets and must therefore be properly synchronized since, because of the distribution of the electromagnets about the needle cylinder, a different needle is positioned, at any one time, at each of the electromagnets.

The synchronization of the recording or storage system with respect to the particular electromagnets does not present a major problem when the record of the pattern is contained either on punched tapes, magnetic tapes or film tapes, since such tapes can store greater amounts of information. However, when fixed memory matrices, having small capacity, are employed, particularly in small diameter circular knitting machines, the matrices are provided with a coded record which allows a single memory unit to be employed for more than one feed system. This use of a coded record increases the capacity of the small fixed memory matrices but requires that the coded output be changed and converted into an independent output for each of the separate knitting feed systems. At least one of the coded outputs, i.e.: the output controlling the needle in any other than the basic or prime feed system, must be delayed in its transmittal to the electromagnetic needle selecting means by an amount equal to the angle of rotation of the needle cylinder corresponding to the number of needles between the point at which the needles are actually counted and the point at which the electromagnetic selecting means is located to which the coded output is transmitted. In general, the coded output from fixed matrices is fed first to a shift register, the length between shifts being equal to the number of spaces between the knitting feed or selecting points. The shift being performed by a clock pulse derived from the needle sensor itself.

The disadvantage of the method as mentioned above consists in that there is either a need for a large capacity pattern memory or storage means, or the necessity of using multiple shift registers for each knitting feed. In both instances, complex expensive devices must be provided. This being a decided disadvantage particularly when more than one knitting machine is controlled from a single memory bank.

It is an object of the present invention to overcome each of the disadvantages noted and to provide a simple versatile memory reading and electronic control system for selectively actuating the needles in a multifeed knitting system.

The foregoing objects, other objects, and the advantages of the present invention will become obvious from the following disclosure of the present invention and its primary embodiment.

SUMMARY OF THE INVENTION

According to the present invention a method and apparatus for the control of a multifeed circular knitting machine is provided wherein the position or number data concerning each of the needles situated at each of the separate knitting feed selecting points are successively fed to the inputs of a reading device for a fixed matrix memory unit. The outputs of the matrix, corresponding to each of the data input, are recorded in sweep circuits associated with each of the electromagnetic selecting means for the respective knitting feed systems to be subsequently triggered by a clock pulse mechanism.

More specifically the present invention provides a method for reading the storage matrix of a circular knitting machine, comprising the steps of counting the passage of the needles by a given point, determining from this counting, the needle at each of the independent selecting means, and thereafter successively feeding the determination relative to each of the selecting means to said matrix. In this manner the control system is made to alternately read the matrix with respect to the position of the needles in each of the feed systems. Preferably the counting is obtained at the position of one of the independent means for selecting the needles, and the data concerning the needles at the other selecting means is obtained thereafter by arithmetically imposing an appropriate constant on this count depending upon the position of the first needle with respect to the second selecting means.

The control system includes counters for determining the course and wale position of each needle, storage means comprising a matrix having assigned columns and lines corresponding to the needle positions in each wale and course and reading means connected to the counter for successively traversing the matrix, in correspondence to the rotation of said needle cylinder. The count is also fed to a comparator to which a gating system is connected, the outputs of which go to certain of the inputs of the reading means. The gating system receives an input simultaneously from a multivibrator providing a periodic clock pulse. As a result the arithmetic sum of the counter and a constant provided by the system of gates is alternately impressed with the determination obtained by the counter on the reading device.

DESCRIPTION OF THE INVENTION

Figure 3:
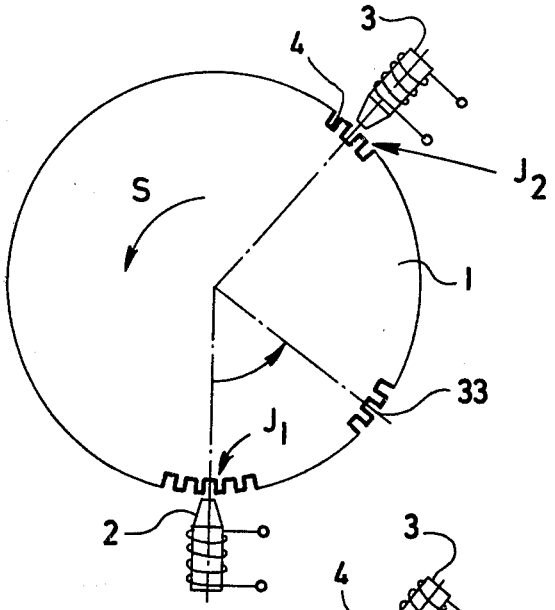
FIG. 3 is a schematic view of the needle cylinder, in horizontal section showing the electromagnets at the given selection points and indicating the marking of the first needle, on the needle cylinder.
Figure 4:
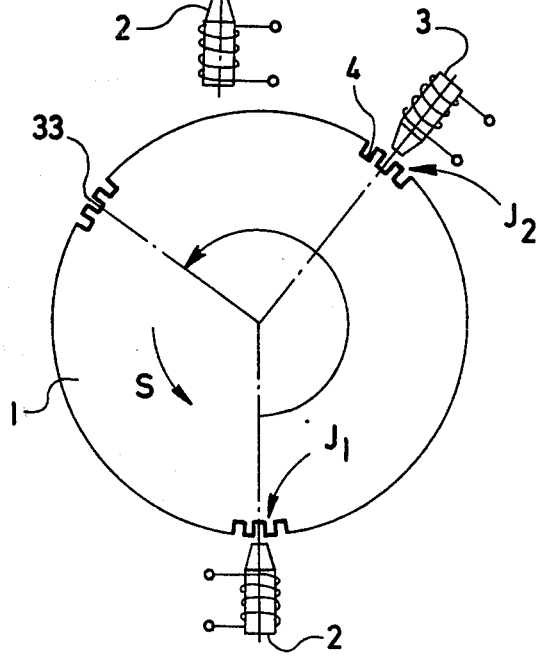
FIG. 4 is a view similar to that of FIG. 3 showing the needle cylinder rotated about a given angle, from that of FIG. 3.

The present invention is applied to a conventional multifeed knitting machine, which for the purpose of illustration, is shown schematically in FIGS. 3 and 4. The knitting machine comprises a rotatable knitting cylinder 1 having two separate knitting feed stations $J_1$ and $J_2$ at which needle selecting members, illustrated as electromagnets 2 and 3, are respectively positioned. The selecting members are located in opposition to the actuating jacks and needles which are slidably mounted in the grooves 4 formed on the circumferential surface of the needle cylinder. Selection of any given needle for a given knitting pattern is obtained by operation or nonoperation of its associated jack by the selecting members, i.e.: by selective excitation of either or both of the electromagnets 2 and 3.

Figure 1:
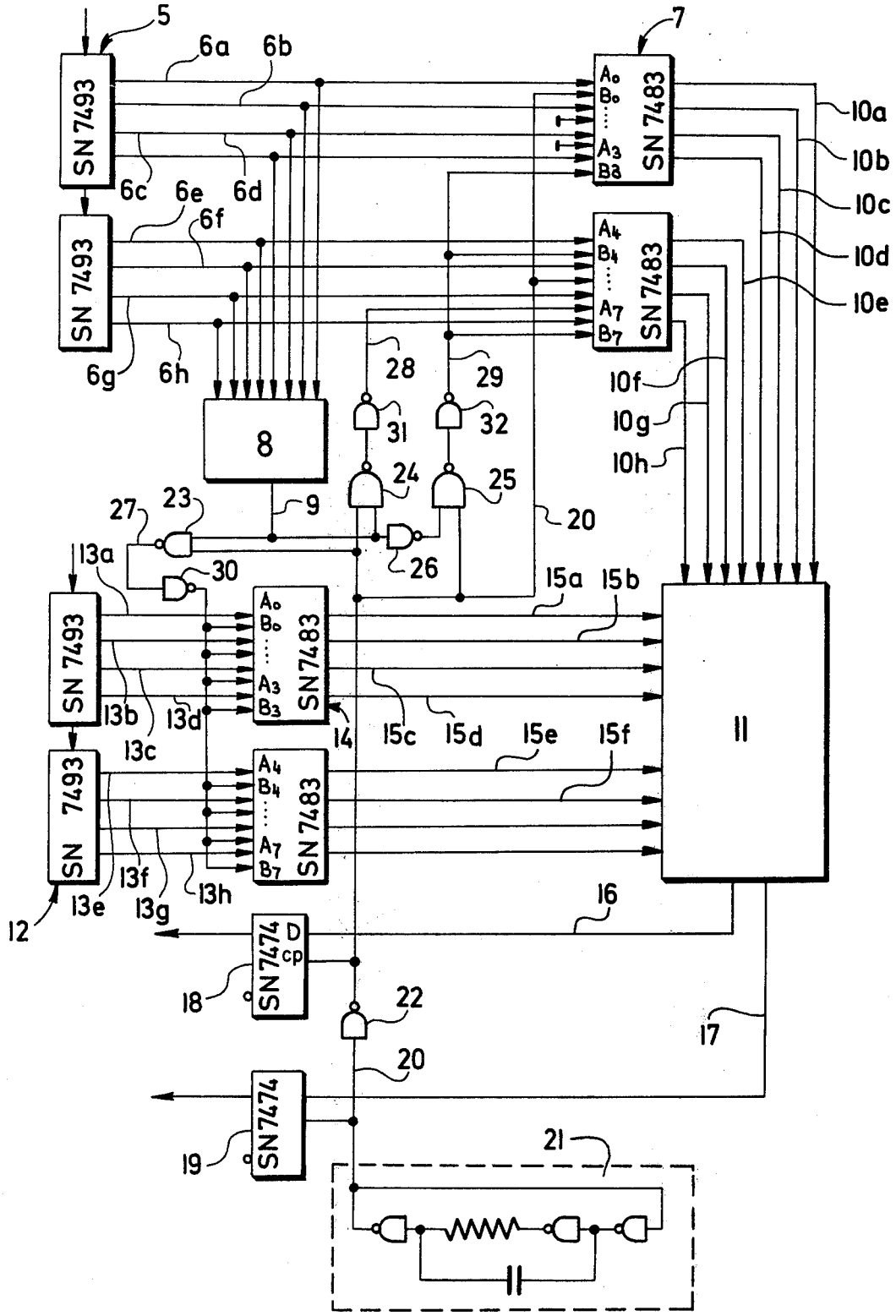
FIG. 1 is a circuit diagram of the electronic control system, according to the present invention including the needle counter, the reading device, the recording matrix and the means for successively determining the data with regard to the specific needles at each of the selecting points in each knitting feed system, with regard to a circular knitting machine having two feed systems and 168 needles, the electromagnets being spaced apart a distance equivalent to 71 needles.

The operation of each of the electromagnets is controlled by an electronic patterning device which includes a rotatable disk, rotated in synchronism with the needle cylinder, and which has provided along its circumference a series of uniformly spaced holes corresponding to the number of needles in the cylinder 1. The disk is also provided with a single hole spaced radially inward from the circumference. A light source is mounted on one side of the disk while on the other side there is mounted a pair of photo-electric scanners. The first photo-electric scanner senses the sequential passage of the circumferential holes,. The second photo-electric scanner senses the passage of the single radially offset hole. Each of the scanners produce a signal as a result of the passage of each hole and due to the rotation of the disk in synchronism with the needle cylinder produces a series of signals which corresponds first to the passage of each needle past a given feed station, normally the first or basic feed station in the knit work pattern, and a single signal indicative of the completion of each of the knitting courses. Each signal is fed respectively to a wave-shaping circuit wherein it is formed into a square or rectangular wave pulse which may then be fed to a unidirectional counter so that passage of the needles to a given feed station as well as the number of revolutions of the needle cylinder can be determined. Such counters are shown in FIG. 1 and will be described at length herein. By locating the scanning device so that the origin of the counting takes place at the basic feed station illustrated in FIGS. 3 and 4 by the letter $J_1$, the exact and specific number of the needles located in sequential order about the knitting cylinder can be determined at any one time. Similarly, since the second feed station indicated by the letter $J_2$ is offset about the needle cylinder by a given number of needle spaces, the needle at this position can likewise be accurately determined at any one time.

For the purposes of further illustration of the present invention; assume that the number of needles in the needle cylinder is 168 (N=168), that feed station $J_1$ is the first feed and $J_1$ is the second feed and that the angle between the feeds in terms of needle spacings is 71 needles (T=71). The needle cylinder is rotated in the direction S as seen in FIGS. 3 and 4. Each of the needles is given a serial number indicative of their position around the cylinder, with the first such numbered needles located in the groove 33, as seein in the FIGS.. In this condition the actual number of each needle at each of the given feed stations $J_1$ or $J_2$ can be determined by counting the needles passing through the first station as a function of the position of the first needle (groove 33) with respect to its location either before or after the second feed station in accordance with the following expressions: $J_2=J_1+N-T$ or $J_2=J_1-T$. The first formula applies when the needle in groove 33 has not yet reached the second feed station indicated by the electromagnet 3 while the second formula applies when the needle in groove 33 has passed beyond the second station, as indicated in FIG. 4. By utilizing these two relationships for separately determining the position of the needles at each of the feeding points, the reading device for activating a coded fixed unit matrix can be so controlled that the data from each of these feed points can be successively applied to the control system. The method and apparatus for carrying out this procedure is seen in FIG. 1.

Turning now to FIG. 1, the rectangular or square wave pulses derived from the first photo-electric scanner associated with the perforated rotating disk are fed to a binary counter 5 formed by two circuits each of the SN7493 type connected in series. The counter 5 is provided with a plurality of output lines **6*a* – 6*h* which are respectively connected simultaneously to the inputs $A_0$ – $A_7$ of a reading device comprising a binary adder 7 (formed of two independent circuits of the type SN7483) and to the inputs of a comparator circuit 8 (seen in detail in FIG. 2). The comparator circuit consists of a system of gates connected in such a manner that on a single output line 9 a logic value of one (1) is given when a number less than the number of needles in the angle between the first and second feed stations $J_1$ and $J_2$ is given. In the illustrated example the output line 9 would have a logic value of one (1) when the specific number of the needle counted at the first feed station $J_1$ is less than 71**.

Figure 2:
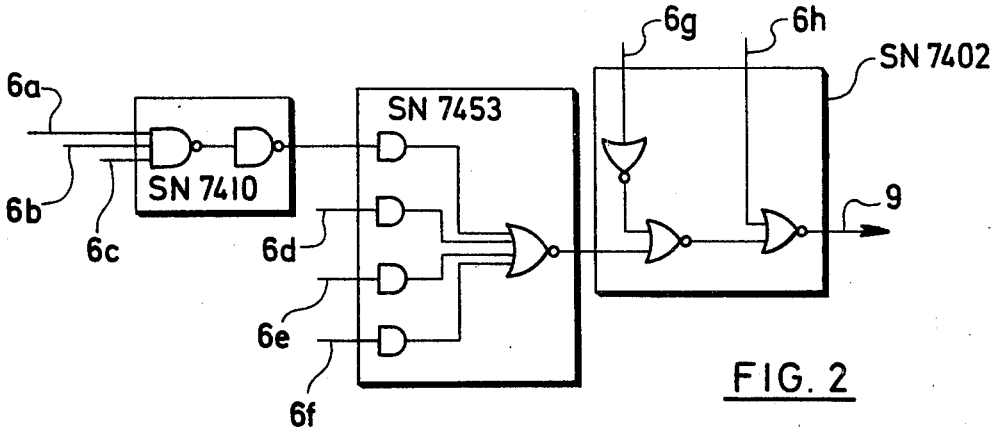
FIG. 2 is a circuit diagram of the comparator employed to determine the needle at the second feed system, employing the first feed system as a base for counting origin.

The comparator 8 is formed, as seen in FIG. 2, by cascading three circuits, the first circuit being of the SN7410 type, receiving signals from the output line **6*a* – 6*c*; the second circuit is of the SN7453 type receiving signals from the output of the first comprising a triple 3 logic element having as an input for line 6*a* a NAND gate circuit and the output lines 6*d* – 6*f*; and the third circuit comprising ¾ ths of a type SN7402 circuit receiving the output from comprising 4 wide 2 logic elements having as input AND/OR inverted gate the second circuit which has Quad 2 logic and an input NOR gate as well as from the output lines 6*g* and 6*h*. The adder 7 comprises one half of a reading device for a fixed information recording matrix 11 and consequently has a plurality of outputs 10*a* – 10*h* which are connected to the column lines of the matrix 11. The matrix 11 is of the type disclosed in Czechoslovakian Pat. No. 135,196 dated July 1, 1966 and U.S. Pat Appln. 649,433 to which reference can be made for further detail if required. The matrix 11 is a programable memory which is connected in an array of 16 inputs and 2 outputs to provide $2^{16} \times 2 = 65{,}536$ two bit words provides a patterning repeat analogue program of one or more fabric pattern repeats and has coded information in each of its columns and lines corresponding to the operational position of the needles in each of their courses. The outputs 10***a* –10*h* represent the position of the needle necessary to trigger the recording matrix.

The square wave pulses derived by the second photoelectric scanner from the single hole in the rotating disk is fed to a course counter 12 which is formed of two circuits SN7493 type which are also arranged in series with each other similar to the circuits of the counter 5. The counter 12 is provided with a plurality of output lines 13*a* – 13*h* which feed directly to inputs $A_0 - A_7$ of a binary counter 14 which forms the second portion of the reading device for the matrix 11. The counter 14 is formed of two independent circuits of the SN7483 type having outputs 15*a* – 15*h* which are connected to the course lines of the matrix 11.

The matrix 11 is provided with two outputs 16 and 17, the first of which leads to a coil of the electromagnet 2 located at the basic feed system $J_1$ which the second leads it to the coil of the electromagnet 3 located at the second feed system $J_2$. Sweep circuits of the "D" type (SN7474) are imposed in lines 16 and 17 respectively prior to the coils of the magnets 2 and 3. Each of the sweep circuits has an input CP to which a clock pulse is fed in series via a line 20 from a multivibrator 21, which produces a square wave continuous pulsing. An invertor 22 is interposed in line 20 between sweep circuits 19 and 18, prior to the input CP of the sweep circuit 18.

The line 20 from the multivibrator 21 continues on beyond the sweep circuit 18 to the input of a system of gates 23, 24 and 25 as well as to input $B_1$ and $B_5$ of the binary adder 7. The system of gates 23, 24 and 25 is arranged so that its second input receives the signal from the output line 9 of the comparator 8. An invertor 26 is interposed in line 9 prior to the input to the gate 25. The gates 23, 24 and 25 are each formed so that when either of the inputs are impressed with the logic value of zero, an output is produced having the logic value one. In any other combination, that is when each input has a logic value equal to one, the output of each of the gates 23, 24, and 25 has a value equal to zero. The gates 23, 24 and 25 have output lines 27, 28 and 29 respectively, in which invertors 30, 31 and 32 are respectively arranged. The output line 27 leads to the inputs $B_0 - B_7$ of the counter 14, output line 28 leads to the input $B_6$ of the adder 7, while the output line 29 leads to the input $B_3$, $B_4$ and $B_7$ of the binary adder 7. The inputs $B_1$ and $B_2$ of the counter 7 are permanently grounded.

The foregoing circuit arrangement, illustrated in FIG. 1, enable the successive impression of a specific data relating to the number of the given needles at the stations $J_1$ and $J_2$ relative to the position of the initial needle (groove 33) with respect to each of the feed systems in accordance with each of the proceeding equations. As a result, the matrix 11 is activated alternately in direct correspondence with the needles position at each of the feed system stations. This occurs in the following manner:

The first and second photo-electric scanners, are arranged at the base feed station $J_1$, and produce signals due to the rotation of the disk, which are transformed by the wave shaping circuits, into rectangular pulses which are introduced respectively into the counters 5 and 12. In this manner the counters 5 and 12 determine serially the numbers of the needles passing station $J_1$ and the number of the courses, or the revolutions of the needle cylinder 1, passing the same station. The output of the counters 5 and 12 are binary digits giving the specific number of the needle located at the feed station $J_1$. The output of the counter 5 is introduced into the inputs $A_0 - A_7$ of the counter 7 and simultaneously to the comparator 8. As explained previously, when the specific needle number is less than 71, the output of the comparator 8 on the output line 9 has a voltage logic value equal to one, and when it is greater than 71 a voltage logic value equal to zero, in the manner previously explained. The output of the comparator 8 is impressed simultaneously upon each of the gates 23, 24 and 25.

Meanwhile, the multivibrator 21, which is a continuously and independently operable, emits at its output 20 a series of rectangular pulses, which act as clock pulses at the output T of the sweep circuit 19, which stores the output information from the output 17 for the second feed station, and after inversion by the invertor 22 to the input CP to the sweep circuit 18, which stores the output information for the control of the basic feed station $J_1$. Simultaneously, the inverted clock pulse from the multivibrator 21 is impressed on each of the second inputs of the gates 23, 24 and 25. Depending upon the condition of the input from the comparator 8 and the input from the inverted multivibrator signal through line 20, the gates 23, 24 and 25 form a constant which is introduced into the inputs $B_0 - B_7$ of the counter 7 in such a manner that the outputs 10*a* – 10*h* provide the number of the needle in accordance with the equation for $J_2$. As will be seen in more detail hereinafter, when the output of the multivibrator has a logic value equal to zero, the volt input to the gates 23, 24 and 25 has voltage logic 1, and as a result the number equivalent to the needle at the position $J_2$, depending upon the value of the output of the comparator 8, is fed to the counter 7. On the other hand, when the multivibrator output has a voltage value equivalent to zero and the input from it on to each of the gates 23, 24 and 25 has a voltage logic value of zero, the number equivalent to the position of the needles at the first feed $J_1$ is fed to the counter 7.

The data, or number of the courses knitted from the beginning of the knit work, or the number of revolutions of the machine, is introduced to outputs $A_0 - A_7$ of the counter 14, from the course counter 12. However, when the initial needle (groove 33) is in the position shown in FIG. 3, the needle at first feed station is knitting a course which is subsequent to that of the course being knitted by the needle at the second feed station. That is, while the needle at the first feed station has a number lower than 71 and the needle at the second feed station has a number higher than 71, they both belong to different course lines. It is therefore necessary to subtract one course from the number indicated by the output lines 13*a* – 13*h* each time the number of the needle at the second feed station $J_2$ is to be indicated, until such time as the needle at the first position $J_1$ has a number greater than 71. This is secured by gate 23 which emits the information from the comparator 8 to the inputs $B_0 - B_7$ of the binary counter 14. As a result, a single course number is subtracted from the binary digit information produced by the course counter 12 and the correct number of the course corresponding to the feed station $J_2$ appears on the outputs 15*a* – 15*h* of the counter 14. When the needle at the first feed station $J_1$ is greater than 71, the output from the comparator 8 has a logic value equal to zero and therefore the logic value of the output beyond the invertor 30 has no effect on the counter 14.

According to the condition of the information obtained in the output 10*a* – 10*h* and simultaneously 15*a* –15*h*, the memory matrix 11 is caused to issue an output signal successively into output lines 16 and 17 for the control of the first and second feed stations $J_1$ and $J_2$ respectively in timed sequences well with the multivibrator clock pulse.

Specifically, the circuit shown in FIG. 1 functions so that when the voltage logic value impressed by line 20 on each of the gates 23, 24 and 25 is a logic zero, the value of the outputs of the gates 23, 24 and 25 becomes a logic one, and thus after inversion in the respective invertors 30, 31 and 32 the value in lines 27, 28, and 29 respectively have the value logic zero. Thus, both counters 7 and 14 remain unchanged and transmit the informational data supplied to them by the counter 5 and 12 respectively. Thus, data and information of the number of the needle in front of the first feed system and the actual course knitted, as determined by the photo-electric scanners, is fed through the matrix 11. On the outputs 16 and 17, of the matrix 11, there will appear the coded, recorded patterned program which is fed to the sweep circuits 18 and 19 respectively. Upon changing the signal in line 20, after inversion by the invertor 22 to the logic value one, the condition of the output in line 16 is transmitted to the sweep circuit 18.

When the voltage logic value is equal to one, behind the invertor 22 in line 20, this input to the gates 23, 24 and 25 is consequently similarly one. In this situation the voltage value of the output of the comparator 8, in line 9, must be considered. In the first instance, when the needle cylinder 1, is in the position shown in FIG. 3, the voltage value in line 9 is a logic one, as a result, both inputs of gates 23, 24 and 25 are of the same logic one and the outputs of each of the gates 23, 24 and 25 is of the logic value zero. As a result of the inversion of the signals in invertor 30 and 31, the voltage in line 27 and line 28 is of the logic value one, while, because of the invertor 32, the voltage in line 29 has a logic value of zero. Thus, a number, is impressed upon inputs $B_0$ –$B_7$ of the counter 7 which is, for a knitting machine having a number of needles N = 168 and a spacing of T = 71 needles, the binary number 01100001, i.e.: 97. This number is a constant equivalent to N – T and thus satisfies the equation $J_2 = J_1 + N - T$. At the outputs 10*a* – 10*h*, of the counter 7, a number simultaneously appears which thus belongs to the needle in front of the second feed. Simultaneously, the logic value one is brought to the inputs $B_0 - B_7$ of the counter 14 from the line 20. This reduces, the number of courses feed from the counter 12 into the counter 14 by one so that the output on lines 15*a* – 15*h* indicates that the needle at the position of $J_2$ is knitting a course preceeding that which is being knitted by the needle at the station $J_1$. As a result, while the outputs 10*a* –10*h* feed to the matrix 11 a needle of a given number, the outputs 15*a* – 15*h* feed simultaneously to the matrix 11 the proper course so that the output from the matrix 11 corresponds in each instance to both the needle and the course in which the needle is being operated.

On the other hand, when the position of the needle cylinder 1 is, as is shown in FIG. 4, a voltage having a logic value of zero is created in the output line 9 of the comparator 8 since the needle positioned at the first station $J_1$ is greater than 71. Thus, the output 28 behind the invertor 31 of the gate 24 produces a logic value equal to zero, while the output 29 behind the invertor 32 a logic value of one is produced. The output 27 behind the invertor 30 also produces a logic value of zero. As a result of the logic value zero output in line 27, no number is added or subtracted to the counter 14 and the number of the course from the counter 12 appears at the input of the matrix 11. The second feed is thus caused to emit the same course pattern was knitted by the preceeding operation of the needles at the first feed $J_1$. Simultaneously, the counter 7 provided at its inputs $B_0$ – $B_7$ with the binary number of 10111001 which by adding to the input number derived from the counting directly at the station $J_1$, a result is obtained, which corresponds to the equation of $J_2 = J_1 - T$. This is according to the rule of subtracting binary numbers, which is performed by adding their supplement. As a consequence on the outputs of matrix 11 the value for the number $J_2$ and the actual course being knitted will appear. The transmission of the signal into the feed circuit 9 is performed again by changing the signal in line 20, from the multivibrator 21 to the value logic one.

It will thus be observed from the foregoing that the present invention provides a simple method and apparatus for providing the recording matrix for a patterning system with successive inputs which directly correspond to the numbers of the needle at each of the given feed stations. While the apparatus has been illustrated employing only two feed stations, it will be apparent that the same system may be adapted so that three or more stations may be easily accomodated.

In the foregoing description reference has been made to various circuits and components. Circuits SN 7402, 7403, 7410, 7453, 7474, 7483, 7493 as well as the multivibrator are products of the Texas Instruments Company, Houston, Texas. Similar circuits are also manufactured by Fairchild Semiconductor Company, 464 Ellis Street, Mountain View, California, 94040. In the catalogue of the Fiarchild Semiconductor Co. of June 1972 there is a comparison between the circuits of Texas Instrument and Fairchild, which show their equivalency. All circuits are fully described in the said catalogues and details of these circuits can be found in, and reference is made to, the above publications which are incorporated herein, as if more fully set forth.

Furthermore, reference can be made for general information regarding several systems to the publication Electronics in Knitting, Charles Reichman, ed. Am.Soc. of Knitting Technologists and The National Knitted Outerwear Assoc. 1972, and for more specific information concerning the outher components, such as the counters, recording matrix, reading device, etc. to the applications:

342,941, filed Mar. 20, 1973 now U.S. Pat. No. 3,861,178.

246,623, filed Apr. 24, 1972 now abandoned.

246,792 filed Apr. 24, 1972 now abandoned.

246,791, filed Apr. 24, 1972 now U.S. Pat. No. 3,874,198.

246,699, filed Apr. 24, 1972 now abandoned.

486,321, filed July 8, 1974 now U.S. Pat. No. 3,940,953.

486,322, filed July 8, 1974 now U.S. Pat. No. 3,969,912.

Various changes, modifications and embodiments have been suggested in the foregoing description, others will be obvious to those skilled in the art. It is intended therefore that the present disclosure be taken as illustrative only and not as limiting of the present invention.

What is claimed:

1. The method for reading the storage matrix of a circular knitting machine having a plurality of needles arranged in order with respect to a given first needle, the output of which is fed to independent means for selecting needles associated with two or more separate simultaneously operable feed systems distributed about the needle cylinder, comprising the steps of counting during each revolution the passage of said needles by a given point and simultaneously arithmetically imposing an appropriate constant on said count depending upon the position of the first needle in said cylinder with respect to each of the subsequent selecting means to determine from said counting the location of a particular needle at any given time at each of said independent selecting means, and successively feeding the several determinations to said matrix, to thereafter successively read said matrix with respect to the position of the needles in each of said separate feed systems and means for feeding the output of said matrix to said associated independent selecting means in timed relationship therewith.

2. The method according to claim 1 wherein said steps of counting and determining are conducted continuously.

3. The method according to claim 1 including the step of initiating said counting at the position of one of said independent means for selecting said needles.

4. A circular knitting machine comprising a needle cylinder having a plurality of needles sequentially arranged thereon operable simultaneously to knit yarn into a plurality of loops in wales and courses in at least two separate knitting systems, each having means for selecting appropriate needles therefor, a patterning control system having means for the storate of a knitting pattern corresponding to each wale and loop, and an output for the control of each of the needle selecting means with respect thereto derived from an input based upon the position of the needles in each knitting system with respect to a given initial point, said control system having means for determining the specific needle in the sequence positioned at each needle selecting means comprising a counter located at one of said selecting means for counting the passage of each needle thereby and means for simultaneously adding to a constant equal to the number of the needles between said knitting systems, and during each revolution feeding said individual determinations to the input of said storage means, and means for feeding said output to said respective selecting means.

5. The knitting machine in accordance with claim 4 wherein said constant has an arithmetical sign depending upon the position of the first of said sequential needles with respect to the other of said selecting means.

6. The knitting machine in accordance with claim 4 wherein each of said selecting means comprises an electromagnet and wherein the output of said storage means are recorded in a sweep circuit operable at predetermined intervals to transmit a pulse to its associated electromagent.

7. The knitting machine according to claim 4 wherein said storage means comprises a matrix having assigned columns and lines corresponding to the needle positions in each wale and course and reading means connected to said counter for successively traversing said matrix, in correspondence to the rotation of said needle cylinder, a gating system connected to certain of the inputs of said reading means, said gating system receiving an input from said means for adding the constant and from means for providing a periodic clock pulse, to thereby impress on said reading means the arithmetic sum of said counter and said constant alternately with the determination obtained by said counter.

8. The knitting machine according to claim 4 wherein said adding means comprises a comparator receiving an input from said counter, and said clock pulse means comprises a multivibrator.

* * * * *